United States Patent [19]

Eby

[11] 3,952,953

[45] Apr. 27, 1976

[54] REACTION ARM FOR ROTARY SPRINKLER

[75] Inventor: Ralph H. Eby, Cincinnati, Ohio

[73] Assignee: John S. Greeno Company, Cincinnati, Ohio

[22] Filed: May 5, 1975

[21] Appl. No.: 574,536

Related U.S. Application Data

[63] Continuation-in-part of Ser. No. 479,857, June 17, 1974.

[52] U.S. Cl. ..... 239/230; 239/233; 239/DIG. 19

[51] Int. Cl.[2] ..... B05B 3/02

[58] Field of Search .... 239/230, 231, 233, DIG. 19, 239/251, 602

[56] References Cited

UNITED STATES PATENTS

| | | | |
|---|---|---|---|
| 1,997,901 | 4/1935 | Englehart | 239/230 |
| 2,592,609 | 4/1952 | Shoemaker | 239/230 |
| 3,022,012 | 2/1962 | Sharp et al. | 239/231 X |
| 3,208,672 | 9/1965 | Sully | 239/230 |
| 3,408,009 | 10/1968 | Friedmann et al. | 239/233 X |
| 3,669,356 | 6/1972 | Senninger | 239/230 |

*Primary Examiner*—Richard A. Schacher
*Assistant Examiner*—Michael Mar
*Attorney, Agent, or Firm*—Biebel, French & Nauman

[57] ABSTRACT

A reaction arm for rotary sprinkler is made of injection molded nylon. The arm is formed in two parts including a head and a main body portion. The head contains the spray diverting and deflecting passageways and the main body portion has a head-supporting shoe on one end, an intermediate pivot portion, and a counterweight portion. The shoe is received within an opening in the head and forms one wall of the water passageway. A counterweight may be added to the arm adjacent the head to provide additional mass to the reaction arm for proper operation of the sprinkler.

8 Claims, 18 Drawing Figures

FIG-1
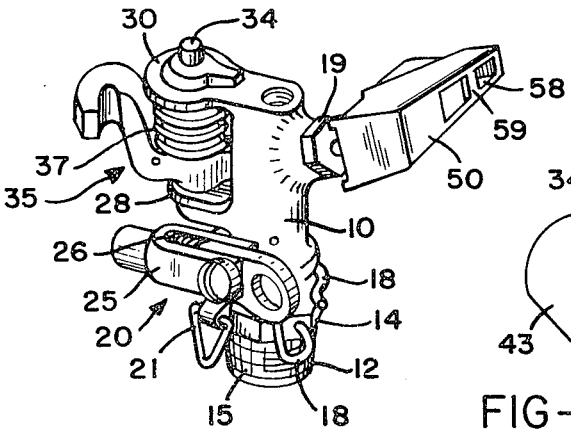
FIG-2
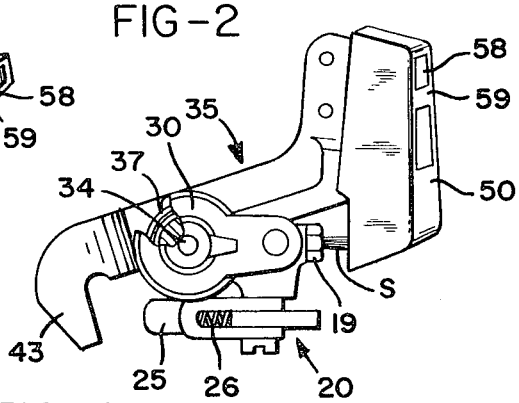
FIG-3
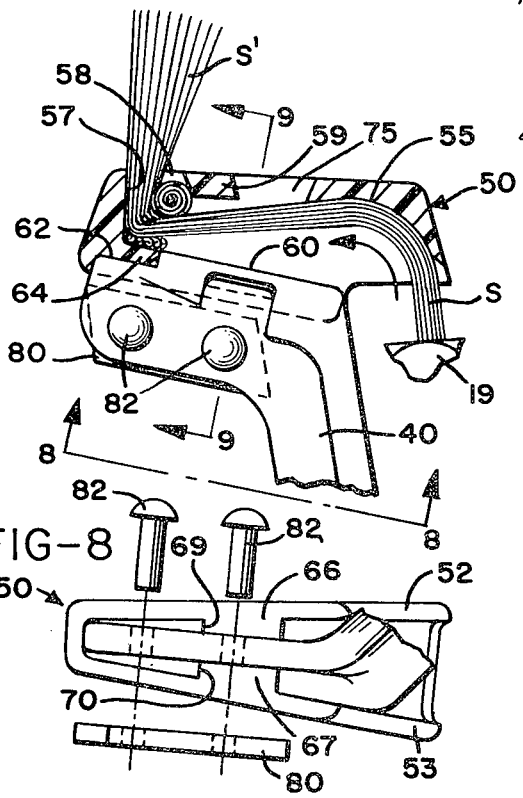
FIG-4
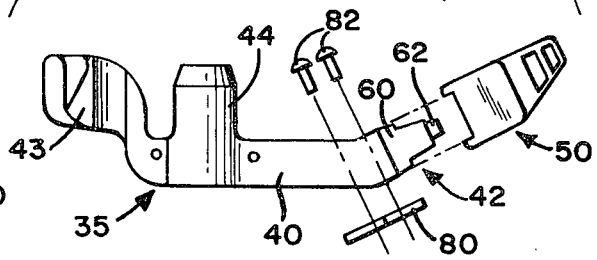
FIG-5
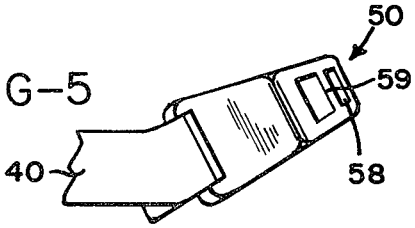
FIG-8
FIG-6
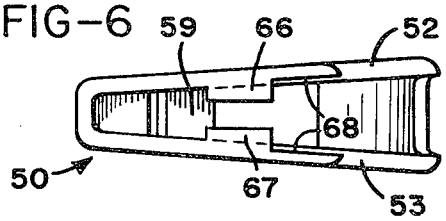
FIG-9
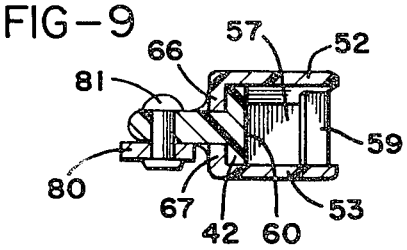
FIG-7
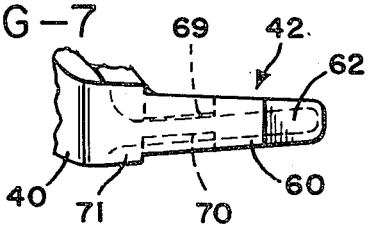

REACTION ARM FOR ROTARY SPRINKLER

This application is a continuation-in-part of U.S. application Ser. No. 479,857, filed June 17, 1974.

BACKGROUND OF THE INVENTION

This invention is directed to impulse sprinklers, and more particularly to an improved reaction arm construction for rotary sprinklers of the general type shown in the U.S. patent of the present inventor and A. R. J. Friedmann, U.S. Pat. No. 3,408,009 issued Oct. 29, 1968 and assigned to the same assignee as this application. Friedman-Eby discloses a rotary sprinkler incorporating an improvement in reaction arm construction, particularly residing in the arrangement of the internal water deflecting passageway which provides a reaction force to the arm and forms an accurately controlled fan-shaped spray outwardly from the arm for controlled uniform distribution of the water over the inner portion of the larger general area covered by the sprinkler.

Rotary impulse sprinklers of this general type may be positioned above the ground, but are often positioned in underground chambers, as disclosed in the Friedmann et al. U.S. Pat. No. 3,434,664, which are generally out of sight and flush with the ground when not in use. Such sprinklers generally include a body having a passageway formed therein for directing water to a nozzle mounted in an upwardly-inclined position on the body. The body is mounted on an inlet conduit for rotation about a generally vertical axis. The reaction arm is pivotally mounted on the body. A deflector member or head is carried on the end of the reaction arm to intercept the concentrated stream from the nozzle and produce a reaction which pivots the reaction arm against the biasing force of a torsion spring and out of the stream. The arm returns under the force of the spring, and successive impacts of the arm on the body produce stepped rotational movement.

Such sprinklers commonly incorporate an adjustable reversing mechanism by which the sprinkler can be caused to travel back and forth within a predetermined arc. Such reversing mechanisms may be taken out of operation to permit full circle sprinkling.

The commercial embodiment of the reaction arm made according to Friedmann-Eby, U.S. Pat. No. 3,408,009 was made as an aluminum casting. It was found that brass, while preferred, formed a reaction arm with a somewhat greater mass than desired, and was also more costly. While the cast aluminum construction resulted in a successful arm, the deflector passageways which were formed in a cored head area were sometimes defective in casting and had to be discarded. Also, the aluminum was inherently subject to a certain amount of corrosion, and this corrosion could be particularly detrimental when the sprinkler was used in an underground environment such as disclosed in Friedmann et al., U.S. Pat. No. 3,434,664. Another problem with metal reaction arms has been abrasion by sand and other abrasive particles in the water, this problem being especially prevalent in dry areas of the Southwestern United States.

SUMMARY OF THE INVENTION

The present invention is directed to an injection molded reaction arm for a rotary sprinkler, the arm specifically comprising an improvement to the construction disclosed and claimed in Friedmann-Eby U.S. Pat. No. 3,408,009. The improved arm is preferably injection molded of a corrosion-resistant plastic material such as nylon. It is molded in two pieces including a main body portion and a head. The body portion is formed with a head support on one end and a counterweight on the other end with a pivoting portion formed therebetween.

A spray deflecting reaction head is mounted on the shoe and may be either riveted or solvent soldered in position. The head is formed with a portion of the walls which define the deflecting passageways, and the shoe itself forms a wall closure and thus at least partially forms one of these walls. The construction of the body portion as well as the shoe is one which is particularly adapted to the injection molded process.

It is accordingly an object of this invention to provide a rotary sprinkler reaction arm formed essentially of plastic resin material which can be selected for maximum service life in accordance with the conditions to which it will be exposed in use.

Another object of the invention resides in the construction of a two-piece reaction arm assembly of plastic material which includes a head forming one portion supported on a shoe forming a part of a second portion of the arm.

These and other objects and advantages of the invention will be apparent from the following description, the accompanying drawings and the appended claims.

BRIEF DESCRIPTION OF THE DRAWINGS

FIG. 1 is a perspective view of a sprinkler incorporating a reaction arm according to this invention;

FIG. 2 is a plan view of the sprinkler illustrating a first embodiment of the invention;

FIG. 3 is an enlarged fragmentary view of one end of the first embodiment, with the head portion thereof in transverse section;

FIG. 4 is an exploded elevational view of the arm of the first embodiment;

FIG. 5 is an enlarged fragmentary view of the first embodiment showing the head assembled to the arm;

FIG. 6 is an elevational view of the first embodiment looking at the inside surface of the head;

FIG. 7 is a fragmentary view of the first embodiment showing the front face of the mounting shoe portion of the arm;

FIG. 8 is a view of the first embodiment showing the shoe and head assembled looking generally along the line 8—8 of FIG. 3;

FIG. 9 is a section of the first embodiment through the assembled head and shoe taken generally along the line 9—9 of FIG. 3;

DESCRIPTION OF THE PREFERRED EMBODIMENTS

Figure 10:
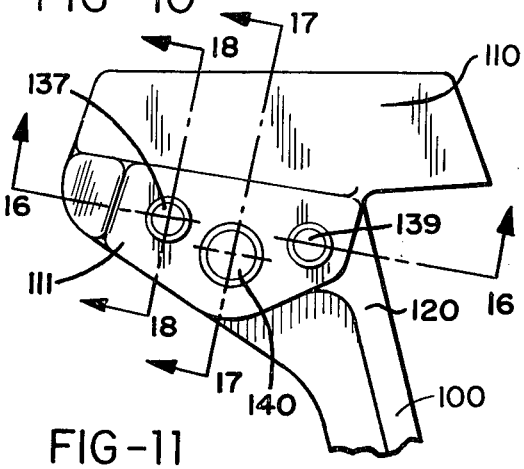
FIG. 10 is an enlarged fragmentary view of one end of the arm illustrating a second embodiment of the invention.

The sprinkler shown in FIGS. 1 and 2 may be of the type which is mounted above the ground or may be of the type received within an underground chamber as shown in the above-identified U.S. Pat. No. 3,434,664, and includes a body 10 which is supported on a hollow shaft extending downwardly from the body and mounted within a fitting 12 for rotation about a vertical axis. A nut 14 secures the fitting 12 to the shaft, and a suitable water spray conduit (not shown) is connected to the fitting 12 by threads 15. A pair of adjustable wire stops 18 are mounted on the upper portion of the fitting to provide for reversing movement of the body 10, as desired. The body 10 is provided with a nozzle 19 which provides a concentrated stream of water S therefrom.

A reversing mechanism 20 includes a toggle 21 mounted on a screw 22 threaded into the body 10. The toggle 21 pivots a stop member 25 through a compression spring 26 from an upper position where it is engaged by the reaction arm to a lower position where it does not interfere with the arm. The reversing mechanism described is included for a full understanding of this invention, but it is understood that this mechanism, as such, forms no part of the present invention.

The body 10 is provided with a pair of transversely-extending, arm-supporting flanges 28 and 30 which are formed with vertically-aligned openings to receive a pin 34. The improved reaction arm 35 is mounted on the pin 34 between the flanges 28 and 30, and a helical torsion spring 37 has its lower end connected to the arm 35 in the openings 38 and its upper end connected to the flange 30. The spring 37 normally tends to hold the arm 35 against the body 10 in the position shown in FIG. 2, but permits outward swinging movement thereof about the pin 34 under the influence of induced reaction from the nozzle.

Reference may be had to FIGS. 3–9 for a further description of this invention. The arm 35 is formed with a main body or support portion 40. The portion 40 has a head-supporting shoe 42 on one end thereof, a counterweight 43 on the opposite end thereof and an axially elongated tubular pivot portion 44 formed therebetween. A spray-deflecting reaction head 50 is mounted on the shoe 42 and defines internal water-diverting passsageways. The parts 40 and 50 are separately injection molded of a suitable high impact, non-corrosive material, preferably nylon, although other materials may be used. It is preferable that the plastic material contain a suitable stabilizer to make the material resistant to the effects of ultra-violet radiation.

The main body or support portion 40 and the head 50 are thus preferably made of the same material, separately molded, and then assembled to form a unitary reaction arm 35. The shoe 42 and the head 50 are provided with interlocking connection means by which these parts may be connected and through which they are self-holding or latched together in the connected position.

Since the head 50 is essentially a hollow body for containing and deflecting a spray of water, it has been found feasible to injection mold it separately from the larger support portion 40. The head 50 is formed with a pair of side walls 52 and 53 which converge in the direction of flow. The walls 52 and 53 define a rear opening and is thus substantially open on the side facing the shoe 42.

A curved spray-deflecting front wall 55 extends between the walls 52 and 53 at the wider end thereof. The wall 55 is generally opposite the open side of the head and is positioned to receive the spray S from the nozzle 19 and to deflect the spray into the interior of the head 50 by turning the spray substantially at a right angle to the direction in which it is received from the nozzle 19. The opposite and narrower end of the head 50 is provided with a transversely opposite impingement wall 57 which extends between the side walls 52 and 53. The impingement wall 57 provides a relatively flat surface against which the turned spray impinges to create a reaction force on the arm and turbulence in the water flow.

An exit opening 58 is provided between the walls 52 and 53 on the front side of the head 50 through which a temporary turbulent spray or fan-shaped spurt is directed outwardly of the head at an angle or in a direction which, as noted in detail hereinafter, converges toward that of the main stream S. An intermediate front wall 59 defines the opposite side of the opening 58 and further forms an internal passageway surface tending to guide the initially directed spray within the head against the impingement wall 57.

The shoe 42 is tapered and is proportioned to be interfitted partially within the head 50 for supporting the head thereon and partially closing the open back side thereof. The shoe 42 is provided with a planar sole surface 60 which, together with the side walls 52 and 53 and the intermediate wall 59, define a transverse flow passage in the head leading from the curved front wall 55 to the impingement wall 57.

Means on the shoe and head for interfitting and locking these parts together include a recessed ledge portion 62 which at the narrower forward end is somewhat offset from the plane of the sole 60 but parallel thereto. This offset ledge portion is positioned to interfit with a platform portion 64 formed in the narrower forward end of the head 50 between the side walls 52 and 53 and adjacent the impingement wall 57. When the head 50 is assembled, the platform portion 64 is interfitted with the right angular space defined by the ledge portion 62, as shown in FIG. 3.

The side walls 52 and 53 are formed with a pair of inwardly extending ears 66 and 67, as shown in FIG. 6. A pair of narrow ledges 68 are also formed in the side walls extending parallel to and immediately rearwardly of the ears 66 and 67. The shoe 42 is provided with a pair of recesses or notches 69 and 70 which are proportioned to receive the ears 66 and 67. Also, the sole 60 is formed with a stepped heel surface 71 which is thus slightly wider than is the sole in the region of the notches, and the heel surface 71 is proportioned to be received between the side walls 52 and 53 on the narrow ledges 68.

Preferred results are obtained if the parts are proportioned so that when the ears 66–67 are received within the notches 69–70, there is a tendency to urge the heel surface 71 against the ledges 68. Thus in assembling the head 50 on the shoe 42, the shoe is inserted between the ears 66 and 67 with the sole 60 facing inwardly of the head. This insertion is accompanied by a slight spreading apart of the walls 52 and 53 until the ledge portion 62 is received on the platform portion 64, and the ears 66 and 67 snap into the notches 69 and 70. At this point, a firm self-supporting, interlocking engagement is provided between the head 50 and the shoe 42. Solvent solder is then applied along the interface surfaces between the side walls 52 and 53 and the exposed back surfaces of the shoe 42, and this solvent serves to cement or weld these parts together. However, even if the solvent is not thoroughly or completely applied, or if it is omitted, the interlocking construction is one in which the head 50 is locked and supported on the arm portion 40 to provide, in effect, a unitary reaction arm.

There is an important angular relation between the impingement wall 57 and the direction of the spray S when the reaction arm is in the position shown in FIG. 3 wherein it intercepts the spray. Due to the small size in which the preferred form of the invention is constructed, the effective lever arm of the reaction arm is relatively short, and this dimensional problem is successfully overcome by inclining the wall 57 so that in the position of the parts shown in FIG. 3, this projection thereof would intercept the spray rather than running substantially parallel therewith as in Friedmann et al. U.S. Pat. No. 3,408,009. For example, in a unit wherein the overall length of the head 50 is approximately 1.5 inches, preferred results have been obtained with the wall 57 extending at an angle of approximately 20° to the direction of the main spray when the parts are in the positions shown in FIG. 3, so that the jet diverted by the curved wall 55 is turned through an angle of substantially more than 90°, e.g., as much as 115°.

This construction, as best illustrated in FIG. 3, provides a number of advantageous operating characteristics. Thus when the head 50 is in its position shown in FIG. 3 wherein it has the maximum intercepting action on the main stream S, this flow is diverted and directed against the inclined flat wall 57. The result is sudden conversion of so much of the velocity of the jet stream as is needed to produce pressure force for the desired effective lever action which moves the reaction arm out of the spray path. Then the converted stream is reformed into a fan-shaped spray or spurt of low velocity for covering the area near the sprinkler which is overshot by the main spray. This action is represented diagrammatically in FIG. 3 by the spray lines S′, and if the volume and velocity of the main stream are sufficiently high, some of the supplemental spray will discharge through the space 75 on the opposite side of the wall 59 from the primary exit opening 58. This fan-shaped spray will be intermittent, since it is composed of successive spurts, each of which consists only of so much water as is intercepted by the head while it is in the path of the main spray.

Since the rotation of the sprinkler depends in part upon the energy of impact on the arm 40 with the sprinkler body 10 for clockwise rotation as viewed in FIG. 2 or with the toggle 21 for counterclockwise rotation, it is necessary that the mass of the reaction arm be sufficient to cause such incremental rotation movement. For this purpose, a counterweight 80 may be added to the arm 40. The counterweight 80 may be formed of brass and attached by a pair of rivets 82 to the arm support portion 40 adjacent the head 50 to provide optimum employment of the counterweight.

The improved reaction arm of the present invention has certain advantages over the arm of Friedmann et al. U.S. Pat. No. 3,408,009. Since the arm is formed of plastic material, it is not subject to corrosion. Further, the injection molding of the parts, particularly the head 50 and the walls and internal passageway defined therein, provide a smooth internal finish and an accurate maintenance of alignment of the parts as compared to a casting.

While the head 50 and the arm portion 40 may be made of different materials, it is preferred that these parts be made of the same material so that the bonding cement applied at the interface connections between these parts will uniformly break down both surfaces by equal amounts. Any suitable plastic material can be used which is resistant to ultraviolet radiation, which has high impact strength, which is easy to bond, and which is resistant to impact cold forming or has low creep characteristics, so that there is a minimum of elongation of the arm under impact conditions. Also, the material should have a high melting point, since under some conditions, it may be operated at high temperatures and the water itself may be warm.

These characteristics are particularly important where, as here, the entire mass of the arm 35 is less than that of the conventional metal arm, and thus it tends to oscillate at a relatively high frequency as compared to that of a conventional metal arm, the actual frequency of oscillation depending upon water pressure and nozzle size. Nylons which are stabilized against ultraviolet radiation with carbon black material or the like are particularly suitable. Also suitable are the polyacetal resins sold by DuPont under the tradename "Delrin" and the nylon resin sold by DuPont under the tradename of "Zytel".

Referring now to FIGS. 10 through 18, there is shown a second embodiment of the instant invention. The reaction arm 100 illustrated there is identical to that shown in FIGS. 1 through 9 except for the support portion and the spray deflecting reaction head 110. The passageway within the head receives a stream of water from the sprinkler and directs the stream in a manner identical to that described above with respect to FIGS. 1 through 9. The arrangement for attaching the head support portion of the arm 100 to the head 110 is, however, different from that described previously.

Figure 14:
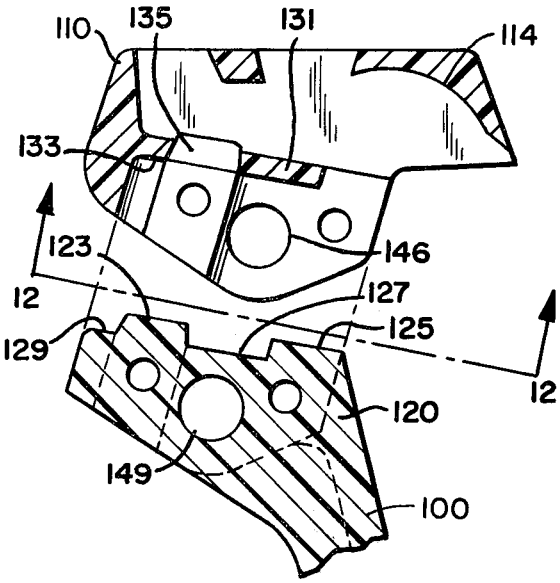
FIG. 14 is a fragmentary exploded view of the second embodiment with the arm and the head portion thereof in transverse section.
Figure 11:
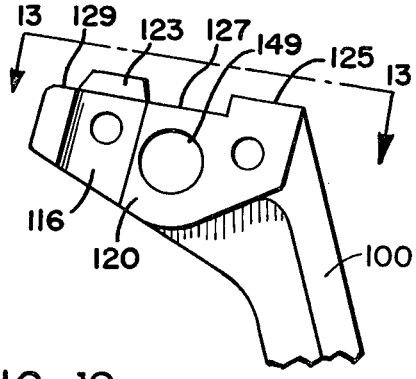
FIG. 11 is a fragmentary view of the mounting shoe of the arm of the second embodiment.
Figure 15:
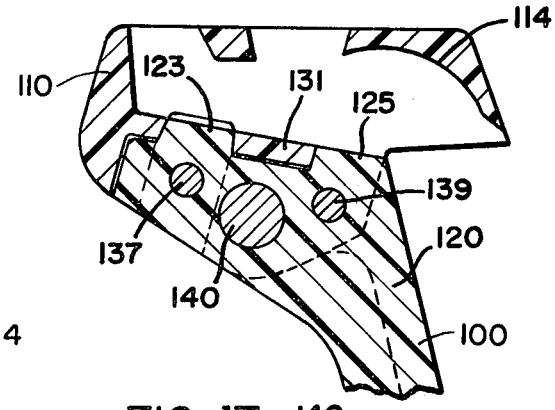
FIG. 15 is a fragmentary view of the head and shoe of the second embodiment assembled in transverse section.
Figure 12:
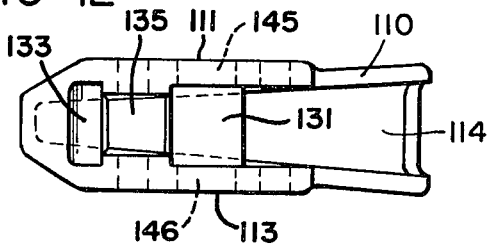
FIG. 12 is an elevational view looking at the inside surface of the head of the second embodiment.
Figure 13:
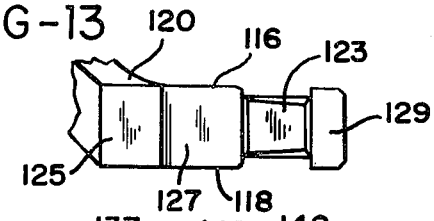
FIG. 13 is a fragmentary view of the front face of the mounting shoe portion of the arm of the second embodiment.

FIG. 10 is an enlarged fragmentary view of the head 110 and arm 100 joined together. The side walls 111 and 113 (FIG. 12) of head 110 extend rearwardly from the front wall 114 so as to engage the upper and lower surfaces 116 and 118, respectively, (FIGS. 11 and 13) of the shoe 120. As shown in FIGS. 14 and 15, the head 110 and shoe 120 are shaped so that the shoe may slide directly between the upper and lower side walls 111 and 113. The surface of shoe 120 facing the head is provided with raised portions 123 and 125 and with recessed portions 127 and 129. As seen in FIG. 14, the head 110 is provided with a wall portion 131 and platform portion 133 which are positioned to engage recess portions 127 and 129 of shoe 120. Additionally, opening 135 between wall 131 and platform 133 is provided to engage raised portion 123. As shown in FIGS. 12 and 13, raised portion 123 is of a narrower thickness than the rest of shoe 120, and opening 135 is appropriately sized to engage raised portion 123 tightly when head 110 is placed on shoe 120. Thus, it is clear from the drawings that the head 110 and shoe 120 are shaped so as to engage each other by sliding together, with the result that relative lateral movement between these components is substantially eliminated.

Figure 17:
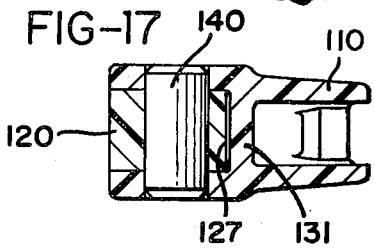
FIG. 17 is a section through the assembled head and shoe taken generally along the line 17-17 of FIG. 10.
Figure 18:
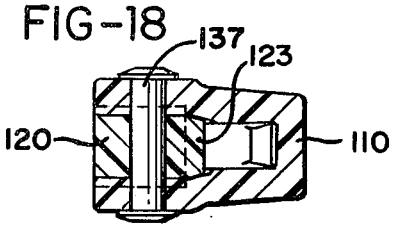
FIG. 18 is a section through the assembled head and shoe taken generally along the line 18-18 of FIG. 10.
Figure 16:
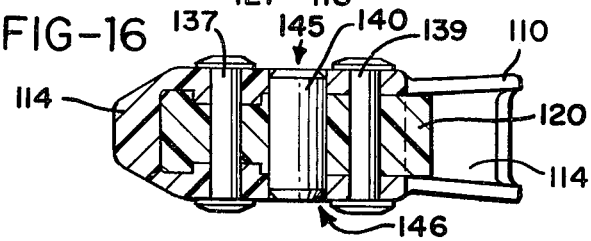
FIG. 16 is a section through the assembled head and shoe taken generally along the line 16-16 of FIG. 10.

Head 110 and shoe 120 are fastened together by connection means passing through the head and through the head supporting portion for positively connecting the head 110 to the head supporting portion. As shown in FIGS. 16–18, this connection means may typically comprise a pair of rivets 137 and 139 which pass through both the side walls 111 and 113 and shoe 120. The mass of the reaction arm may be increased by the use of counterweight 140 made of an appropriate material which may typically be pressed into an opening defined by the head 110 and the head supporting portion of the reaction arm. Specifically a first opening 145 and a second opening 146 are defined by the side walls, and a third opening 149 is defined by the shoe 120.

These first, second and third openings are so positioned that when the head is engaged by the shoe portion of the reaction arm, the center of the third opening 149 is slightly out of alignment with an axis defined by the centers of the first and second openings 145 and 146. When the counterweight 140 is pressed into openings 145, 146, and 149, this slight misalignment causes the counter weight 140 to be tightly engaged by the reaction arm and further causes the shoe 120 and the head 110 to be pressed together tightly.

As with the first embodiment, the embodiment of FIGS. 10–18 may advantageously be constructed of any suitable plastic material and may be formed through an injection molding process. The head 110 and shoe 120 may be formed of different types of material, however, since the interlocking action of the counterweight 140, as described, makes it unnecessary to apply bonding cement to the components.

The invention thus offers the further advantage of the ability to select materials in accordance with the service conditions to be encountered. This is especially important, for example, in the case of sprinklers designed for use in areas wherein the water available for sprinkler systems is likely to contain sand or other abrasive particles capable of causing destructive abrasion of metal parts. For such uses, it is merely necessary to select plastic materials of the appropriate properties, such as resins reinforced with suitable fillers, which are otherwise suitable for injection molding for the purposes of the invention.

While the forms of apparatus herein described constitute preferred embodiments of the invention, it is to be understood that the invention is not limited to these precise forms of apparatus, and that changes may be made therein without departing from the scope of the invention.

What is claimed is:

1. A reaction arm for a rotary sprinkler comprising a support portion having a head-supporting shoe on one end and a counterweight on the other end and defining a pivot portion therebetween, a spray deflecting reaction head mounted on said shoe, said head having a pair of side walls in spaced relation defining a rear opening at the side thereof facing said shoe, means on said head defining a front opening, said head having a front wall extended between said side walls opposite said rear opening to receive a water stream from the sprinkler through said rear opening to turn said stream therethrough substantially at a right angle to its original direction of flow, said head further having a transversely opposite wall extended between said side walls to receive said stream after it leaves said front wall and to direct the same through said front opening in a direction which is in converging relation with that of said water stream entering said head, said support portion and said head being injection molded of plastic resin material, said shoe fitting between said side walls, and said head being connected to said shoe at said side walls such that said rear opening is partially closed and a transverse flow passage leading from said front wall to said transversely opposite wall is defined by said shoe and said front wall in combination with said side walls.

2. The arm of claim 1 in which said head is solvent soldered to said shoe along said side walls.

3. The reaction arm of claim 1 further comprising means passing through said pair of side walls and said shoe and positively connecting said head to said shoe.

4. The reaction arm of claim 3 in which said means passing through said pair of side walls comprises means for riveting said head to said shoe.

5. The reaction arm of claim 3 in which a first side wall of said pair of side walls defines a first opening, a second side wall of said pair of side walls defines a second opening and in which said shoe defines a third opening, said first, second and third openings being so positioned that when said head is engaged by said arm, the center of said third opening is slightly out of alignment with an axis defined by the centers of said first and second openings, and further comprising a counterweight pressed into said first, second and third openings, whereby said counterweight is held in place and said head and said shoe are urged into tight engagement.

6. A reaction arm for a rotary sprinkler comprising a support portion having a head-supporting shoe on one end and a counterweight on the other end and defining a pivot portion therebetween, a spray deflecting reaction head mounted on said shoe, said head having a pair of generally converging side walls in spaced relation defining a rear opening at the side thereof facing said shoe, said head having a curved front wall extended between said side walls opposite said rear opening to receive a water stream from the sprinkler through said rear opening to turn said stream therethrough substantially at a right angle to its original direction of flow, said head further having a transversely opposite impingement wall extended between said side walls and positioned to receive the turned stream and create turbulence, means in said shoe defining a front opening adjacent said impingement wall through which said turbulent water stream is directed along a path which is in converging relation with that of said water stream entering said head, said head being connected to said shoe at said side walls, partially closing said rear opening, and defining therein a transverse flow passage leading from said curved wall to said impingement wall, said shoe and said head being separately injection molded of a plastic resin material and having mutually interfitting portions locking said parts together.

7. A reaction impact arm for a rotary sprinkler comprising:

an injection molded head having passageway means therein communicating with a front opening for turning a stream of water from the sprinkler substantially at a right angle to its original direction of flow, and for directing said stream through said front opening in a direction which is in converging relation with that of the original direction of flow of said stream to create a reaction force for driving said arm, said head further having a pair of rearwardly extending side walls, an injection molded head support arm portion having an intermediate pivot portion and a head supporting portion and a counterweight portion at the opposite ends thereof, said head supporting portion being positioned between and engaging said side walls such that relative lateral movement between said head and said head supporting portion is substantially eliminated, connection means passing through said side walls and said head supporting portion for positively connecting said head to said head supporting portion, and a counterweight pressed into openings in said side walls and said head supporting portion.

8. A reaction arm for a rotary sprinkler comprising:

a support portion having a head-supporting shoe on one end and a counterweight on the other end and defining a pivot portion therebetween, said shoe having raised and recessed portions, a spray deflecting reaction head mounted on said shoe, said head having a pair of side walls in spaced relation defining a rear opening such that said head is substantially open at the side thereof facing said shoe, means on said head defining a front opening, said head having a front wall extended between said side walls opposite said rear opening to receive a water stream from the sprinkler through said rear opening to turn the stream therethrough substantially at a right angle to its original direction of flow, said head further having a transversely opposite wall extended between said side walls to receive the turned stream and direct the same through said front opening in a direction which is in converging relation with that of the stream entering said head, said head further having a wall portion and a platform portion extending between said side walls at the side thereof facing said shoe, said support portion and said head being injection molded of plastic resin material, and rivet means extending through said side walls and said head and connecting said head to said shoe at said side walls whereby the open side of said head is partially closed, said recessed portions of said shoe engage said wall portion and said platform portion of said head, and a transverse flow passage leading from said front wall to said impingement wall is defined by said shoe and said front wall in combination with said side walls.

* * * * *